US012427373B1

(12) United States Patent
Tseng

(10) Patent No.: US 12,427,373 B1
(45) Date of Patent: Sep. 30, 2025

(54) HIP ADDUCTOR AND ABDUCTOR MACHINE

(71) Applicant: ZHANG ZHOU LI YUAN SPORTING GOODS CO., LTD., Zhangzhou (CN)

(72) Inventor: Chien Chang Tseng, Zhangzhou (CN)

( * ) Notice: Subject to any disclaimer, the term of this patent is extended or adjusted under 35 U.S.C. 154(b) by 0 days.

(21) Appl. No.: 19/098,449

(22) Filed: Apr. 2, 2025

(30) Foreign Application Priority Data

Mar. 24, 2025 (CN) ..... 202520514190.2

(51) Int. Cl.

| | |
|---|---|
| ***A63B 23/04*** | (2006.01) |
| ***A63B 21/00*** | (2006.01) |
| ***A63B 21/04*** | (2006.01) |
| ***A63B 21/055*** | (2006.01) |
| ***A63B 21/22*** | (2006.01) |
| ***A63B 22/00*** | (2006.01) |
| ***A63B 23/035*** | (2006.01) |

(52) U.S. Cl.
CPC ..... *A63B 23/0417* (2013.01); *A63B 21/0421* (2013.01); *A63B 21/0552* (2013.01); *A63B 21/22* (2013.01); *A63B 21/4047* (2015.10); *A63B 23/0482* (2013.01); *A63B 22/0061* (2013.01); *A63B 23/0355* (2013.01); *A63B 23/0488* (2013.01)

(58) Field of Classification Search
CPC . A63B 21/0421; A63B 21/0552; A63B 21/22; A63B 21/4047; A63B 22/0061; A63B 23/0417; A63B 23/0355; A63B 23/0482; A63B 23/0488
See application file for complete search history.

(56) References Cited

U.S. PATENT DOCUMENTS

| | | | | |
|---|---|---|---|---|
| 5,720,702 | A * | 2/1998 | Lee | A63B 21/169 482/904 |
| 7,857,738 | B2 * | 12/2010 | Reyes | A63B 21/023 482/121 |
| 7,959,544 | B2 * | 6/2011 | Palmer | A63B 22/203 482/130 |
| 2011/0263389 | A1 * | 10/2011 | Burgassi | A63B 21/4047 482/79 |
| 2017/0259113 | A1 * | 9/2017 | Chen | A63B 22/18 |

* cited by examiner

*Primary Examiner* — Megan Anderson

(57) ABSTRACT

A hip adductor and abductor machine, wherein an action structure is installed on both sides of a device frame; the action structure comprises a pivot rotatably pivoted on the device frame, and rotating arms are installed on the pivot; one end of a resistance structure is connected to the device frame, and the other end thereof is provided with a connecting hook; when the device is in an abduction function state, two ends of a retractable elastic resistance rope are fixed on the rotating arms on both sides; when the device is in an adduction function state, a pin passes through the rotating arm and the connecting hook to connect the rotating arm and the resistance structure. The invention provides a machine with small volume, simple operation and dual functions of hip adduction and abduction.

10 Claims, 4 Drawing Sheets

HIP ADDUCTOR AND ABDUCTOR MACHINE

TECHNICAL FIELD

The invention relates to the field of fitness equipment, in particular to a hip adductor and abductor machine.

BACKGROUND ART

Human hip training involves numerous muscle groups and joints, and is relatively difficult.

At present, the equipment for exercising the legs includes an adductor machine and an abductor machine, which occupy the space. Generally, families or small places cannot purchase such exercise equipment, and they can only use these exercise equipment in gyms.

SUMMARY OF THE INVENTION

The invention provides a hip adductor and abductor machine, which aims to solve the shortcomings of the prior art and provide a machine with small volume, simple operation and dual functions of hip adduction and abduction.

The technical solution adopted by the invention to solve the technical problems is as follows.

A hip adductor and abductor machine, wherein:

an action structure is installed on both sides of a device frame; the action structure comprises a pivot rotatably pivoted on the device frame, and rotating arms are installed on the pivot; one end of a resistance structure is connected to the device frame, and the other end thereof is provided with a connecting hook; when the device is in an abduction function state, two ends of a retractable elastic resistance rope are fixed on the rotating arms on both sides; when the device is in an adduction function state, a pin passes through the rotating arm and the connecting hook to connect the rotating arm and the resistance structure.

The retractable elastic resistance rope is a retractable elastic rubber rope; alternatively, the combination of a resistance rope body and elastic elements forms a retractable elastic resistance rope, and the combination form is that the elastic elements are respectively connected to the two ends of the resistance rope body, or the elastic elements are arranged in a middle of the resistance rope body.

A steering wheel is pivoted on the rotating arm; when the device is in an abduction function state, one end of the resistance rope is fixed on the rotating arm on one side, and then pulled obliquely to bypass an outside of the steering wheel on the rotating arm on the opposite side, and then pulled horizontally to bypass the outside of the steering wheel on the rotating arm on this side, and then pulled obliquely; the other end of the resistance rope is fixed on the rotating arm on the opposite side.

A tensioning wheel is pivoted on a steering arm at a rear of the steering wheel; one end of the resistance rope is fixed to the rotating arm on one side, and then pulled obliquely to press against an inner side of the tensioning wheel on the rotating arm on the opposite side then bypass an outer side of the steering wheel on the rotating arm on the opposite side, and then pulled horizontally to bypass the outer side of the steering wheel on the rotating arm on this side; press against the inner side of the tensioning wheel on the rotating arm on this side, and then pulled obliquely; the other end of the resistance rope is fixed to the rotating arm on the opposite side.

The resistance structure is a torsion spring; one end of the torsion spring sleeved on the pivot is fixed to the device frame by a limiting pin, and the other end of the torsion spring is a connecting hook; when the device is in an adduction function state, the pin passes through the rotating arm and the connecting hook to connect the rotating arm and the resistance structure.

The resistance structure is a motor or a spring with one end connected to the device frame.

The pin is a screw rod portion with a knob; a through screw hole is provided on the rotating arm, and the screw rod portion of the knob is screwed into the through screw hole; when the knob is turned upward, the screw portion of the knob is separated from the connecting hook; when the knob is turned downward, the screw portion of the knob passes through the connecting hook.

The rotating arm comprises an upper rotating arm and a lower rotating arm, and a pedal tube is installed at a front end of the lower rotating arm.

A transverse hollow tube is provided at a front end of the inclined lower rotating arm, and an outer positioning hole and an inner positioning hole are respectively provided on side walls of the hollow tube on both sides of the lower rotating arm;

the device is provided with a pedal tube which comprises a positioning tube with a small diameter and a pedal tube body with a large diameter; a positioning bead is installed on the positioning tube, and a spring is provided inside the positioning tube to push the positioning bead out; the diameter of a side wall of the positioning tube is smaller than the diameter of a positioning bead hole of the positioning bead, and a top of the positioning bead is higher than an inner diameter of the hollow tube when it is bounced up;

when the device is in an abduction function state:

the positioning tube of the pedal tube is inserted into the hollow tube from an inside, and the spring bounces up to push the positioning bead into the outer positioning hole and then get stuck;

when the device is in an adduction function state:

the positioning tube of the pedal tube is inserted into the hollow tube from an outside, and the spring bounces up to push the positioning bead into the inner positioning hole and then get stuck.

A seat and armrests are installed at a top of the device frame.

A leg pad with a leg contact surface is installed at an end of the rotating arm.

The beneficial effects of the invention are:

The hip adductor and abductor machine of the invention has a small size, occupies a small space, is easy to carry, and can change the hip adduction function and abduction function training with simple operation, so it is convenient to use in general families and offices.

BRIEF DESCRIPTION OF THE DRAWINGS

The invention will be further described hereinafter with reference to the drawings and embodiments.

SPECIFIC EMBODIMENT OF THE INVENTION

Figure 1:
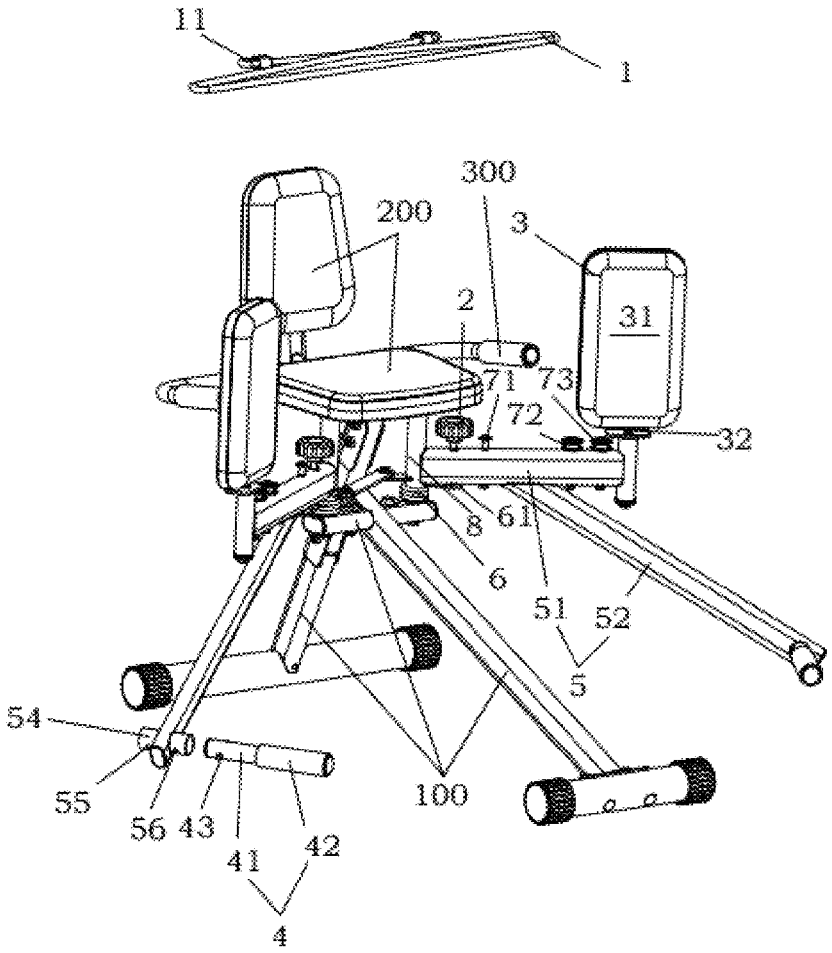
FIG. 1 is a three-dimensional exploded view according to the invention.

In order to more clearly illustrate the technical solution of the invention, the drawings required for the description will be briefly introduced hereinafter. Obviously, the drawings described hereinafter are only some embodiments of the invention. For ordinary technicians in this field, other embodiments can be obtained based on these drawings without creative work. In order to facilitate the understanding of the invention, the invention will be further described in detail hereinafter with reference to the drawings and embodiments.

It should be noted that when an element is described as being "fixed to" another element, it can be directly on the other element, or one or more intermediate elements can exist between them. When an element is described as being "connected to" another element, it can be directly connected to the other element, or one or more intermediate elements can exist between them. The orientation or positional relationship indicated by the terms "upper", "lower", "inner", "outer", "bottom" etc. are based on the orientation or positional relationship shown in the drawings, and is only for the convenience of describing the invention and simplifying the description, but not indicate or imply that the pointed device or element must have a specific orientation, be constructed and operated in a specific orientation, and therefore cannot be understood as a limitation of the invention. In addition, the terms "first", "second", and "third" are only used for descriptive purposes, and cannot be understood as indicating or implying relative importance.

Figure 6:
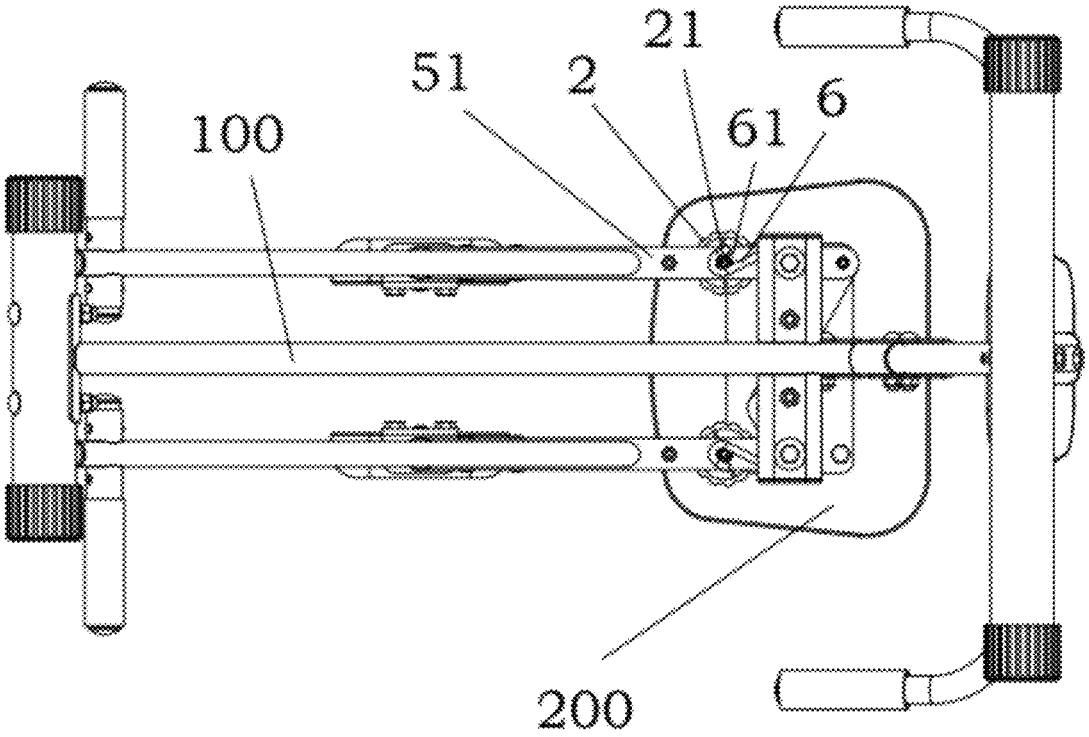
FIG. 6 is a bottom view according to the invention in an adduction function state.

As shown in FIGS. 1 and 6.

The invention comprises a device frame 100 as a basis which is provided with two front and rear legs, and a seat 200 and armrests 300 located on the left and right sides are installed on a top of the device frame 100.

Action structures are installed symmetrically on both sides of the device frame 100.

The action structure comprises a first pivot 8 rotatably pivoted on the device frame 100.

One end of the torsion spring 6 sleeved on the first pivot 8 is fixed to the device frame 100 by a limiting pin, and the other end of the torsion spring 6 is a hook-shaped torsion spring connecting hook 61.

Rotating arms 5 are installed on the first pivot 8, and the rotating arm 5 comprises an upper rotating arm 51 and a lower rotating arm 52.

A vertical through screw hole is provided on the horizontal upper rotating arm 51, and a screw portion 21 of a knob 2 is screwed in the through screw hole. A fixing pin 71 is provided on the upper rotating arm 51. The upper rotating arm 51 is also provided with a rear pulley 72 and a front pulley 73 in front of the fixing pin 71. The leg pad 3 is rotatably pivoted at a front end of the upper rotating arm 51 by a second pivot 32, and the leg pad 3 is provided with a leg contact surface 31.

A transverse hollow tube 54 is provided at a front end of the inclined lower rotating arm 52, and an outer positioning hole 55 and an inner positioning hole 56 are respectively provided on side walls of the hollow tube 54 on both sides of the lower rotating arm 52.

The device is provided with a pedal tube 4 which comprises a positioning tube 41 with a small diameter and a pedal tube body 42 with a large diameter; a positioning bead 43 is installed on the positioning tube 41, and a spring is provided inside the positioning tube 41 to push the positioning bead 43 out; the diameter of a side wall of the positioning tube 41 is smaller than the diameter of a positioning bead hole of the positioning bead 43, and a top of the positioning bead 43 is higher than an inner diameter of the hollow tube 54 when it is bounced up, but it will not fall out of the positioning bead hole.

The device is provided with a retractable elastic resistance rope 1, which is a retractable elastic rubber rope with fixing rings 11 at both ends.

Figure 2:
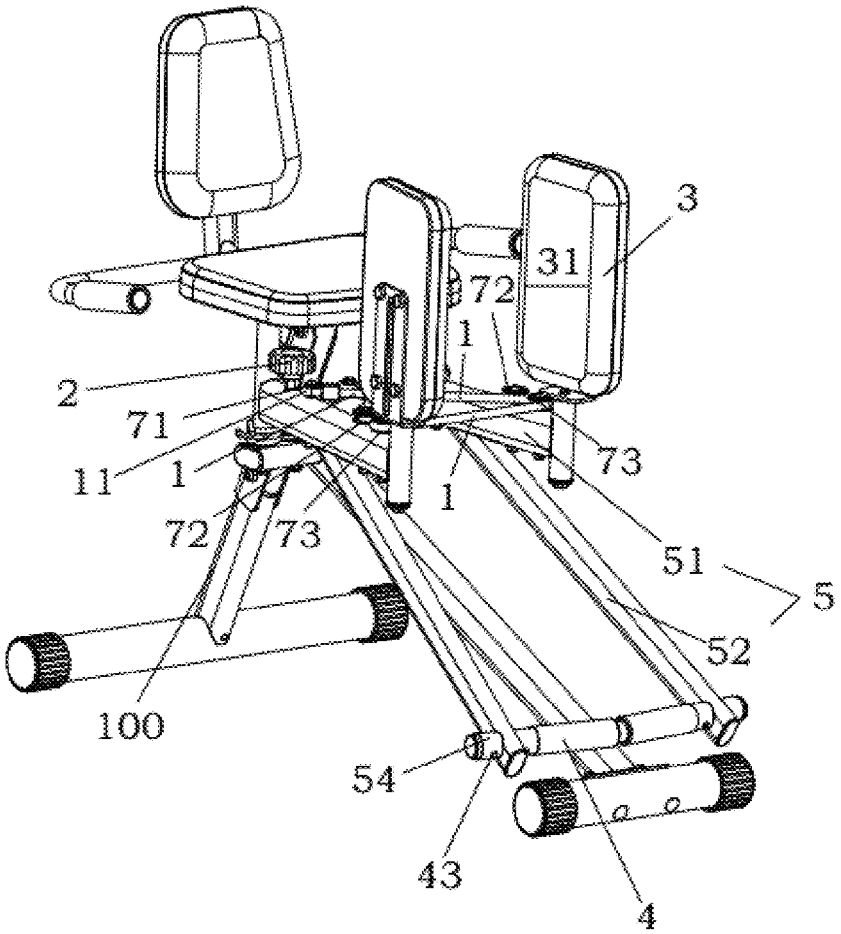
FIG. 2 is a perspective view according to the invention in an abduction function state.
Figure 3:
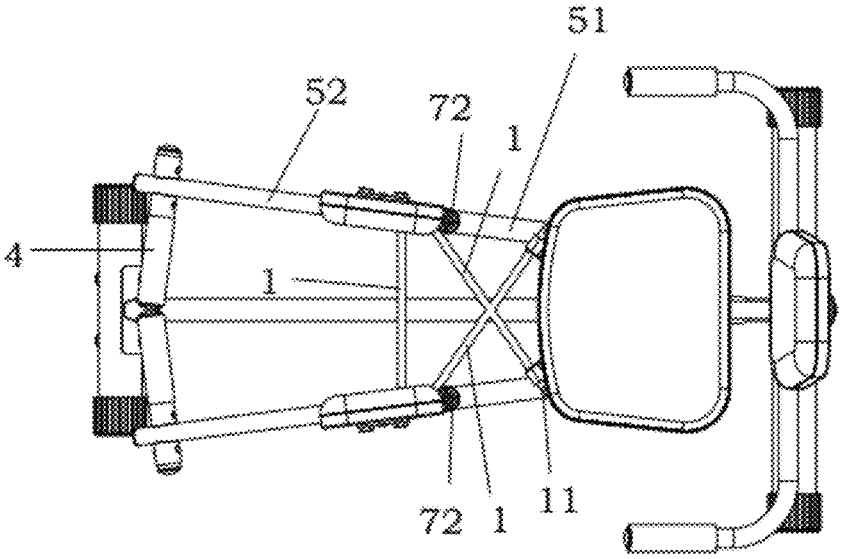
FIG. 3 is a top view according to the invention in an abduction function state.

As shown in FIGS. 1-3.

When the abduction function is used:

turn the knob 2 upward to disengage the torsion spring connecting hook 61 at an end of the torsion spring 6.

Insert the positioning tube 41 of the pedal tube 4 into the hollow tube 54 from an inside. During the insertion process, an inner wall of the hollow tube 54 of the positioning bead 43 is pressed into the positioning bead hole and the spring is compressed. When the positioning bead 43 reaches the position of the outer positioning hole 55, the spring bounces up and pushes the positioning bead 43 into the outer positioning hole 55 and then gets stuck, so that the pedal tube 4 is positioned. At the same time, the step between the positioning tube 41 with a small diameter and the pedal tube body 42 with a large diameter can be pressed against an inner side of the hollow tube 54 to prevent the pedal tube 4 from moving outward.

In other embodiments, a fixed pedal tube structure may be used, or a latch may be used instead of a positioning bead to connect the fixed pedal tube and the hollow tube.

Rotate the leg pad 3 so that the leg contact surface 31 of the leg pad 3 faces inward.

In other embodiments, the leg pad may be provided with leg contact surfaces on both sides so that the leg pad can be used directly without rotating it.

Rotate the upper rotating arms 51 on both sides inward to a suitable position. The fixing ring 11 at one end of the retractable elastic resistance rope 1 is sleeved on the fixing pin 71 on the upper rotating arm 51 on one side, and then pulled obliquely to hold an inner side of the rear pulley 72 on the upper rotating arm 51 on the opposite side, and then bypass an outer side of the front pulley 73 on the upper rotating arm 51 on the opposite side, and then pulled horizontally to bypass an outer side of the front pulley 73 on the upper rotating arm 51 on this side, and hold an inner side of the rear pulley 72 on the upper rotating arm 51 on this side, and then pulled obliquely; the fixing ring 11 at the other end of the resistance rope 1 is sleeved on the fixing pin 71 on the upper rotating arm 51 on the opposite side.

In this way, the two ends of the retractable elastic resistance rope 1 are fixed on the upper rotating arms 51 on both sides, and by pass the two front pulleys 73 serving as steering wheels and the two rear pulleys 72 serving as tensioning wheels in the middle.

In other embodiments, the tensioning wheel may not be used and only the steering wheel may be used.

In other embodiments, for the resistance rope:

the two ends of the resistance rope can be directly fixed on the upper rotating arms on both sides;

The resistance rope body can be an inelastic rope, with elastic elements such as springs connected to both ends of the resistance rope body; alternatively, elastic elements such as springs are provided in a middle of the resistance rope body. In this way, the combination of the resistance rope body and the elastic elements forms a retractable and elastic resistance rope.

When in use:

the user sits on the seat 200, holds the armrests 300 on the left and right sides, rests his legs on the leg contact surfaces 31 on the left and right sides, steps his feet on the pedal tube bodies 42 on the left and right sides, and moves his legs outward with force. At this time, the upper rotating arms 51 on both sides rotate outward, and the retractable elastic resistance rope 1 is stretched. The generated resistance needs to be overcome by the legs, thereby achieving the effect of hip abduction.

Figure 4:
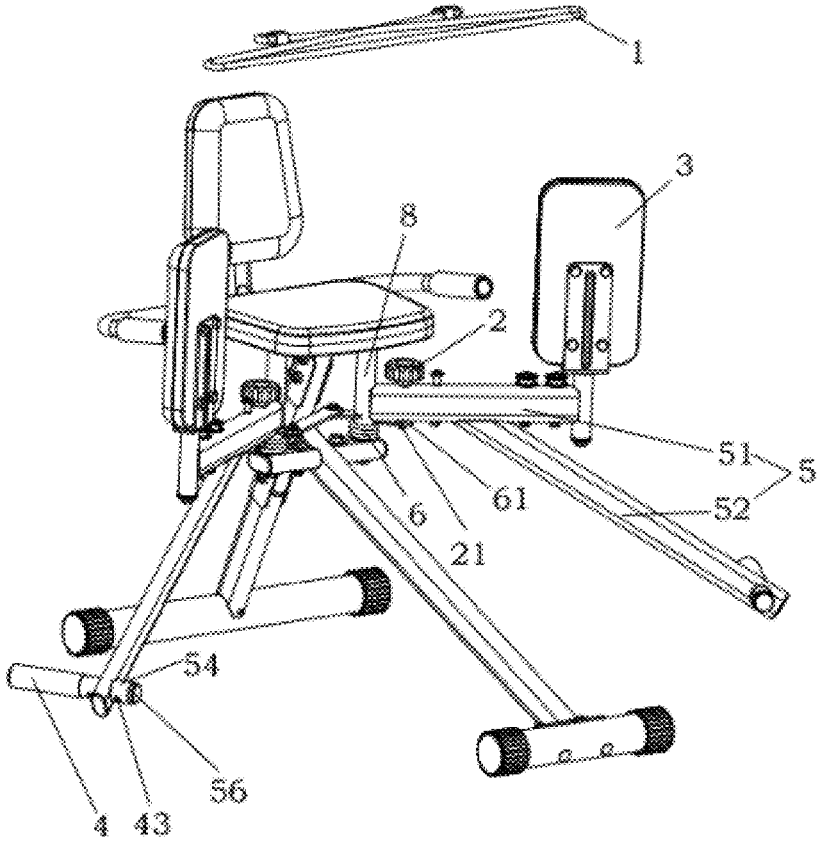
FIG. 4 is a perspective view according to the invention in an adduction function state.
Figure 5:
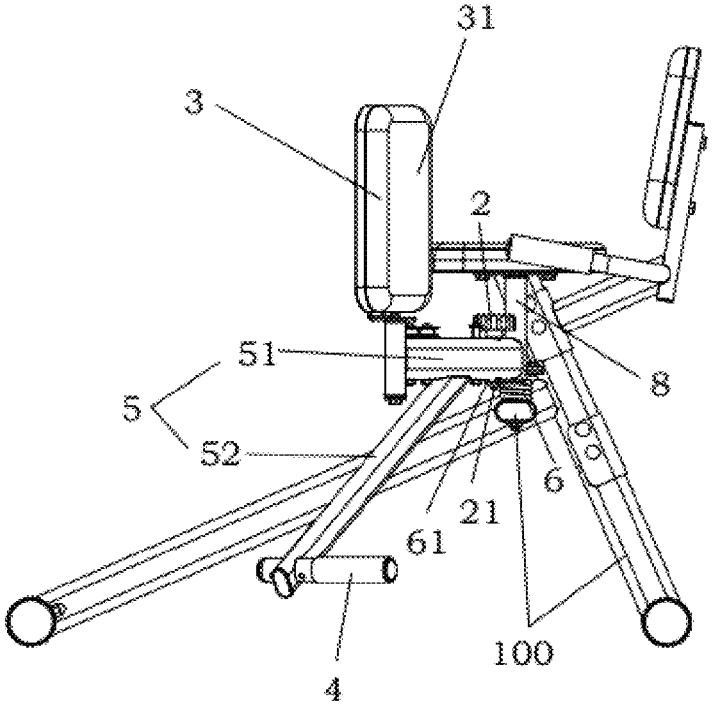
FIG. 5 is a side view according to the invention in an adduction function state.

As shown in FIGS. 4-6:

When the adduction function is used:

remove the retractable elastic resistance rope 1;

rotate the upper rotating arms 51 on both sides outward to a suitable position;

turn the knob 2 downward to insert it into the torsion spring connecting hook 61 at an end of the torsion spring 6.

In other embodiments, instead of using a knob form that matches a threaded screw hole to match the torsion spring, a latch may be used to insert into the torsion spring connecting hook.

In other embodiments, instead of using a torsion spring, other resistance structures may be used, such as a motor, or a spring with one end connected to the device frame. One end of the resistance structure is connected to the device frame, and the connecting hook at the other end can be engaged with or disengaged from the pin.

Insert the positioning tube 41 of the pedal tube 4 into the hollow tube 54 from an outside until the positioning bead 43 reaches the position of the inner positioning hole 56. The spring bounces up and pushes the positioning bead 43 into the inner positioning hole 56 and gets stuck, so that the pedal tube 4 is positioned.

Rotate the leg pad 3 so that the leg contact surface 31 of the leg pad 3 faces outward.

When in use:

The user sits on the seat 200, holds the armrests 300 on the left and right sides, rests his legs on the leg contact surfaces 31 on the left and right sides, steps his feet on the pedal tube bodies 42 on the left and right sides, and moves his legs inward with force. At this time, the upper rotating arms 51 on both sides rotate inward, the torsion spring 6 deforms, and the resistance generated needs to be overcome by the legs, thereby achieving the effect of hip adduction.

In this specification, each embodiment is described in a progressive manner, and each embodiment focuses on the differences from other embodiments, and the same and similar parts between the embodiments can be referred to each other. The above description of the embodiments enables professionals and technicians in this field to implement or use the invention. Various modifications to these embodiments will be obvious to professionals and technicians in this field, and the general principles defined herein can be implemented in other embodiments without departing from the spirit or scope of the invention. Therefore, the invention will not be limited to the embodiments shown herein, but will conform to the widest range consistent with the principles and novel features disclosed herein.

The invention claimed is:

1. A hip adductor and abductor machine, wherein an action structure is installed on both sides of a device frame; the action structures each comprises a first pivot rotatably pivoted on the device frame and a rotating arm is installed on each of the first pivots; one end of a resistance structure is connected to the device frame, and the other end thereof is provided with a connecting hook; when the hip adductor and abductor machine is in an abduction function state, two ends of a retractable elastic resistance rope are fixed on the rotating arms on both sides; when the device is in an adduction function state, a pin passes through the rotating arms and the connecting hook to connect the rotating arms and the resistance structure.

2. The hip adductor and abductor machine of claim 1, wherein a steering wheel is pivoted on each of the rotating arms; when the device is in the abduction function state, one end of the retractable elastic resistance rope is fixed on the rotating arm on one side, and then pulled obliquely to bypass an outside of the steering wheel on the rotating arm on the opposite side, and then pulled horizontally to bypass the outside of the steering wheel on the rotating arm on this side, and then pulled obliquely; the other end of the retractable elastic resistance rope is fixed on the rotating arm on the opposite side.

3. The hip adductor and abductor machine of claim 2, wherein a tensioning wheel is pivoted on a steering arm at a rear of each of the steering wheel; one end of the retractable elastic resistance rope is fixed to the rotating arm on one side, and then pulled obliquely to press against an inner side of the tensioning wheel on the rotating arm on the opposite side then bypass an outer side of the steering wheel on the rotating arm on the opposite side, and then pulled horizontally to bypass the outer side of the steering wheel on the rotating arm on this side; press against the inner side of the tensioning wheel on the rotating arm on this side, and then pulled obliquely; the other end of the retractable elastic resistance rope is fixed to the rotating arm on the opposite side.

4. The hip adductor and abductor machine of claim 1, wherein the rotating arms each comprises an upper rotating arm and a lower rotating arm, and a pedal tube is installed at a front end of each the lower rotating arm.

5. The hip adductor and abductor machine of claim 4, wherein a transverse hollow tube is provided at a front end of each of the lower rotating arm, and a outer positioning hole and an inner positioning hole are respectively provided on side walls of the hollow tube on both sides of the lower rotating arm; walls of the hollow tube on both sides of the lower rotating arm;

the hip adductor and abductor machine is provided with a pedal tube which comprises a positioning tube with a small diameter and a pedal tube body with a large diameter; a positioning bead is installed on the positioning tube, and a spring is provided inside the positioning tube to push the positioning bead out; the diameter of a side wall of the positioning tube is smaller than the diameter of a positioning bead hole of the positioning bead, and a top of the positioning bead is higher than an inner diameter of the hollow tube when it is bounced up;

when the hip adductor and abductor machine is in the abduction function state:

the positioning tube of the pedal tube is inserted into the hollow tube from an inside, and the spring bounces up to push the positioning bead into the outer positioning hole and then get stuck;

when the hip adductor and abductor machine is in the adduction function state:

the positioning tube of the pedal tube is inserted into the hollow tube from an outside, and the spring bounces up to push the positioning bead into the inner positioning hole and then get stuck.

6. The hip adductor and abductor machine of claim 1, wherein the retractable elastic resistance rope is a retractable elastic rubber rope; alternatively, the combination of a resistance rope body and elastic elements forms a retractable elastic resistance rope, and the combination form is that the elastic elements are respectively connected to the two ends of the resistance rope body, or the elastic elements are arranged in a middle of the resistance rope body.

7. The hip adductor and abductor machine of claim 1, wherein the resistance structure is a torsion spring; one end of the torsion spring sleeved on the first pivot is fixed to the device frame by a limiting pin, and the other end of the torsion spring is the connecting hook; when the device is in the adduction function state, the pin passes through the rotating arm and the connecting hook to connect the rotating arm and the resistance structure.

8. The hip adductor and abductor machine of claim 1, wherein the resistance structure is a motor or a spring with one end connected to the device frame.

9. The hip adductor and abductor machine of claim 1, wherein the pin is a screw rod portion with a knob; a through screw hole is provided on each of the rotating arms, and the screw rod portion of the knob is screwed into the through each screw hole; when the knob is turned upward, the screw portion of the knob is separated from the connecting hook; when the knob is turned downward, the screw portion of the knob passes through the connecting hook.

10. The hip adductor and abductor machine of claim 1, wherein a seat and armrests are installed at a top of the device frame, and a leg pad with a leg contact surface is installed at each end of the rotating arms.

* * * * *